US009797082B2

(12) United States Patent
Qu et al.

(10) Patent No.: US 9,797,082 B2
(45) **Date of Patent: *Oct. 24, 2017**

(54) FRONT-LOADING WASHING MACHINE

(71) Applicant: WUXI LITTLE SWAN CO., LTD., Wuxi (CN)

(72) Inventors: Honglian Qu, Wuxi (CN); Yusheng Tang, Wuxi (CN); Kyunghag Kim, Wuxi (CN)

(73) Assignee: WUXI LITTLE SWAN CO., LTD., Wuxi (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/340,427

(22) Filed: Nov. 1, 2016

(65) Prior Publication Data

US 2017/0218548 A1 Aug. 3, 2017

(30) Foreign Application Priority Data

Jan. 28, 2016 (CN) ..... 2016 1 0059248
Jan. 28, 2016 (CN) ..... 2016 2 0086371 U

(51) Int. Cl.
*D06F 37/30* (2006.01)
*D06F 37/26* (2006.01)
*D06F 37/10* (2006.01)

(52) U.S. Cl.
CPC ..... *D06F 37/30* (2013.01); *D06F 37/10* (2013.01); *D06F 37/26* (2013.01); *D06F 37/302* (2013.01)

(58) Field of Classification Search
CPC ..... B66F 3/28
See application file for complete search history.

(56) References Cited

U.S. PATENT DOCUMENTS 5,442,937 A * 8/1995 Kwon ..... D06F 23/00 68/12.27
2007/0227200 A1* 10/2007 Kim ..... D06F 37/22 68/140
2009/0315387 A1* 12/2009 Smith ..... B60P 3/40 298/1 A
2012/0042697 A1* 2/2012 Hong ..... D06F 33/02 68/12.23

FOREIGN PATENT DOCUMENTS

JP 2006288901 A * 10/2006

* cited by examiner

*Primary Examiner* — Jason Ko
*Assistant Examiner* — Spencer Ball
(74) *Attorney, Agent, or Firm* — Hodgson Russ LLP

(57) ABSTRACT

The present disclosure discloses a front-loading washing machine including a cabinet having a front panel, in which the front panel is provided with an opening; a tub having an access port for loading and unloading clothes, in which the tub is disposed in the cabinet and configured in such a manner that the access port is capable of being moved up and down in the opening; a rotatable drum disposed in the tub; a door unit mounted to the tub and configured to cover the access port; and a driving mechanism configured to drive the tub to rotate, in which the driving mechanism is provided in the cabinet and coupled with the tub. The front-loading washing machine according to embodiments of the present disclosure has advantages of user-friendliness, low clothes abrasion, water saving and the like.

13 Claims, 5 Drawing Sheets

FRONT-LOADING WASHING MACHINE

CROSS-REFERENCE TO RELATED APPLICATION

This application claims priority to and benefits of Chinese Patent Application Serial No. 201610059248.4 and Chinese Patent Application Serial No. 201620086371.0, filed with the State Intellectual Property Office of P. R. China on Jan. 28, 2016, the entire content of which is incorporated herein by reference.

FIELD

The present disclosure relates to a technical field of electric appliance manufacturing, and more particularly to a front-loading washing machine.

BACKGROUND

In the related art, a washing machine includes a front-loading washing machine and a pulsator type washing machine. When a pulsator type washing machine is used for washing clothes, the clothes need to be fully soaked in water, so the pulsator type washing machine is poor in water conservation. While a user has to stoop and crouch for loading the clothes or unloading them when using the front-loading washing machine, so the front-loading washing machine is very inconvenient to use, particularly difficult for elderly people and other special populations to operate.

SUMMARY

The present disclosure seeks to solve at least one of the problems existing in the related art to at least some extent. Therefore, the present disclosure provides a front-loading washing machine which has advantages of being convenient to use, low in abrasion on clothes, and water saving.

To accomplish the above objective, embodiments of the present disclosure provide a front-loading washing machine including a cabinet having a front panel, in which the front panel is provided with an opening; a tub having an access port for loading and unloading clothes, in which the tub is disposed in the cabinet and configured in such a manner that the access port is capable of being moved up and down in the opening; a rotatable drum disposed in the tub; a door unit mounted to the tub and configured to cover the access port; and a driving mechanism configured to drive the tub to rotate, in which the driving mechanism is provided in the cabinet and coupled with the tub.

The front-loading washing machine according to the embodiments of the present disclosure has advantages of user-friendliness, little clothes abrasion, water saving and the like.

In addition, the front-loading washing machine according to the embodiments of the present disclosure may further have following additional technical features.

According to an embodiment of the present disclosure, the driving mechanism is configured to drive the access port to move up and down between a washing position and a non-washing position in the opening.

According to an embodiment of the present disclosure, when the access port is located at the non-washing position, the access port is driven to move close to an upper edge of the front panel, and when the access port is located at the washing position, the access port is driven to move close to a lower edge of the front panel.

According to an embodiment of the present disclosure, the driving mechanism is configured to drive the access port to move upwards to close to an upper edge of the front panel and move downwards to close to a lower edge of the front panel.

According to an embodiment of the present disclosure, the driving mechanism includes a longitudinal pushrod disposed at a front side of the tub.

According to an embodiment of the present disclosure, the longitudinal pushrod includes: a drive portion; and a telescopic portion, mounted to the drive portion and driven to telescope by the drive portion, in which one of the drive portion and the telescopic portion is mounted in the cabinet, and the other thereof is coupled with the tub.

According to an embodiment of the present disclosure, the drive portion is coupled with the tub through a drive portion mounting frame, and the telescopic portion is mounted in the cabinet through a telescopic portion mounting frame.

According to an embodiment of the present disclosure, at least one of connections between the drive portion and the drive portion mounting frame and between the telescopic portion and the telescopic portion mounting frame is pivotable.

According to an embodiment of the present disclosure, the drive portion is connected with the drive portion mounting frame through a drive portion positioning pin, and the telescopic portion is connected with the telescopic portion mounting frame through a telescopic portion positioning pin.

According to an embodiment of the present disclosure, each of the drive portion mounting frame and the telescopic portion mounting frame includes: a mounting plate; and two mounting lugs, used for assembling the drive portion positioning pin or the telescopic portion positioning pin, and disposed on the mounting plate and spaced apart from each other.

Figure 1:
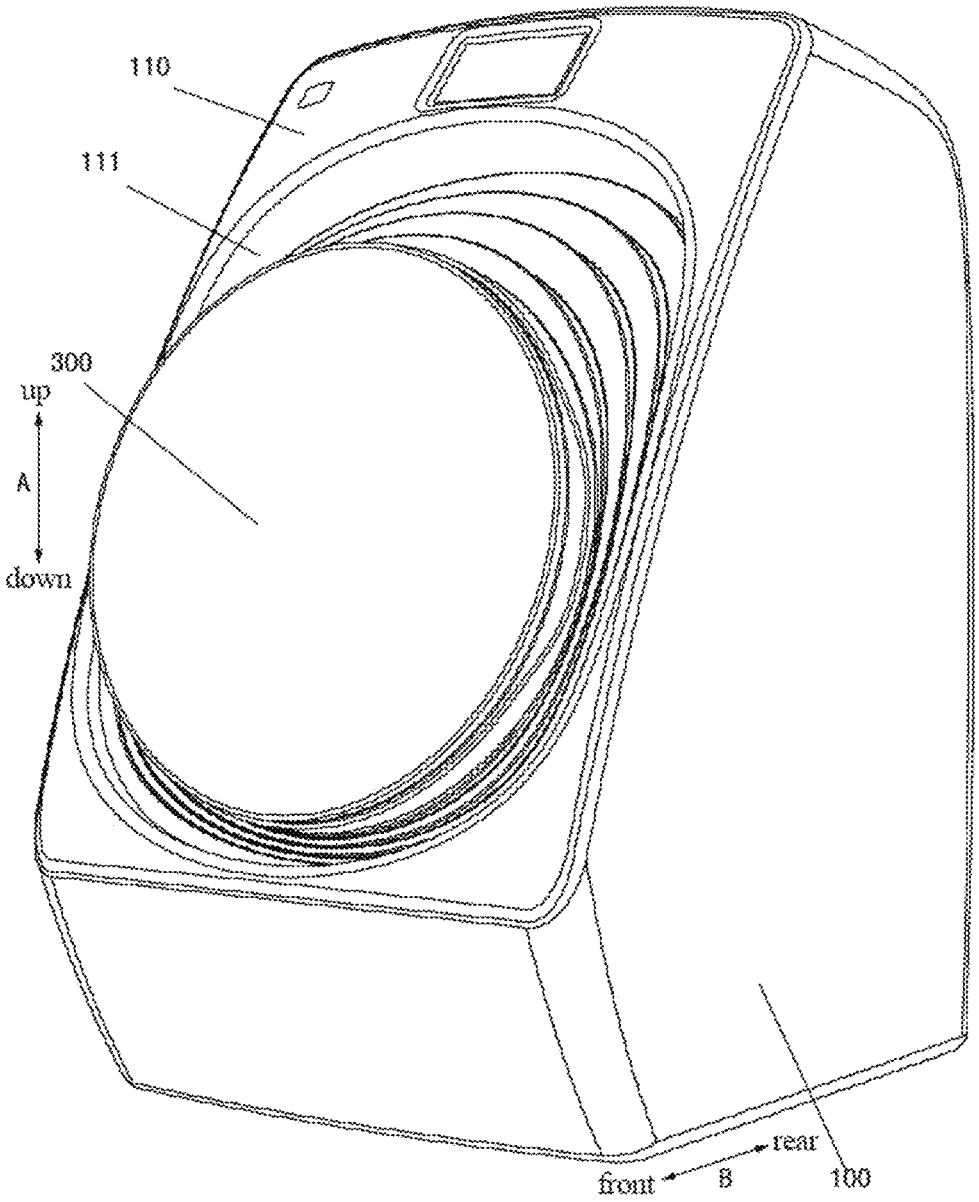
FIG. 1 is a schematic view of a front-loading washing machine according to embodiments of the present disclosure, in which the access port is located at a washing position.

Reference numerals: front-loading washing machine 1; cabinet 100; front panel 110; opening 111; bottom panel 120; tub 200; door unit 300; driving mechanism 400; longitudinal pushrod 410; drive portion 411; drive portion mounting frame 4110; mounting plate 4111; mounting lug 4112; drive portion positioning pin 4113; telescopic portion 412; telescopic portion mounting frame 4120; telescopic portion positioning pin 4123; transverse shaft 420; support frame 430; hole 431; longitudinal bracket 432; protrusion 4320;

transverse bracket 433; main body portion 4330; arc portion 4331; damping vibration absorption mount 500; damper 510; damping internal rod 511;

damping external cylinder 512; damping elastic member 520; support leg 530; adjustable bottom foot 600; vibration absorption pad 610; balance block 700.

DETAILED DESCRIPTION

Reference will be made in detail to embodiments of the present disclosure. Examples of the embodiments are shown in the drawings. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the following, a front-loading washing machine 1 according to embodiments of the present disclosure will be described with reference to the drawings.

As shown in FIG. 1 to FIG. 5, the front-loading washing machine 1 according to the embodiments of the present disclosure includes a cabinet 100, a tub 200, a rotatable drum (not shown in the figures), door unit 300 and a driving mechanism 400.

Figure 2:
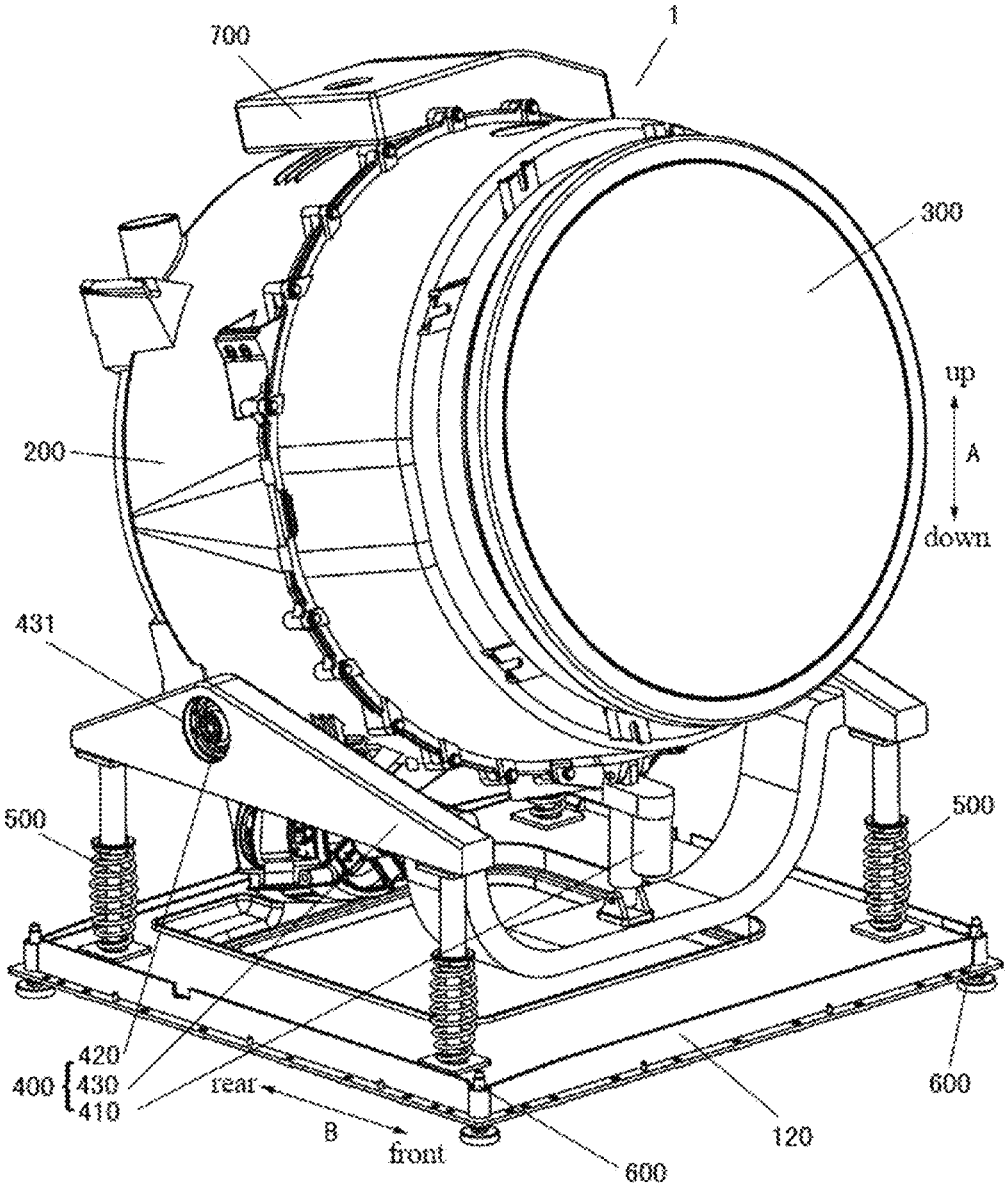
FIG. 2 is a partially schematic view of a front-loading washing machine according to embodiments of the present disclosure, in which the access port is located at the washing position.
Figure 3:
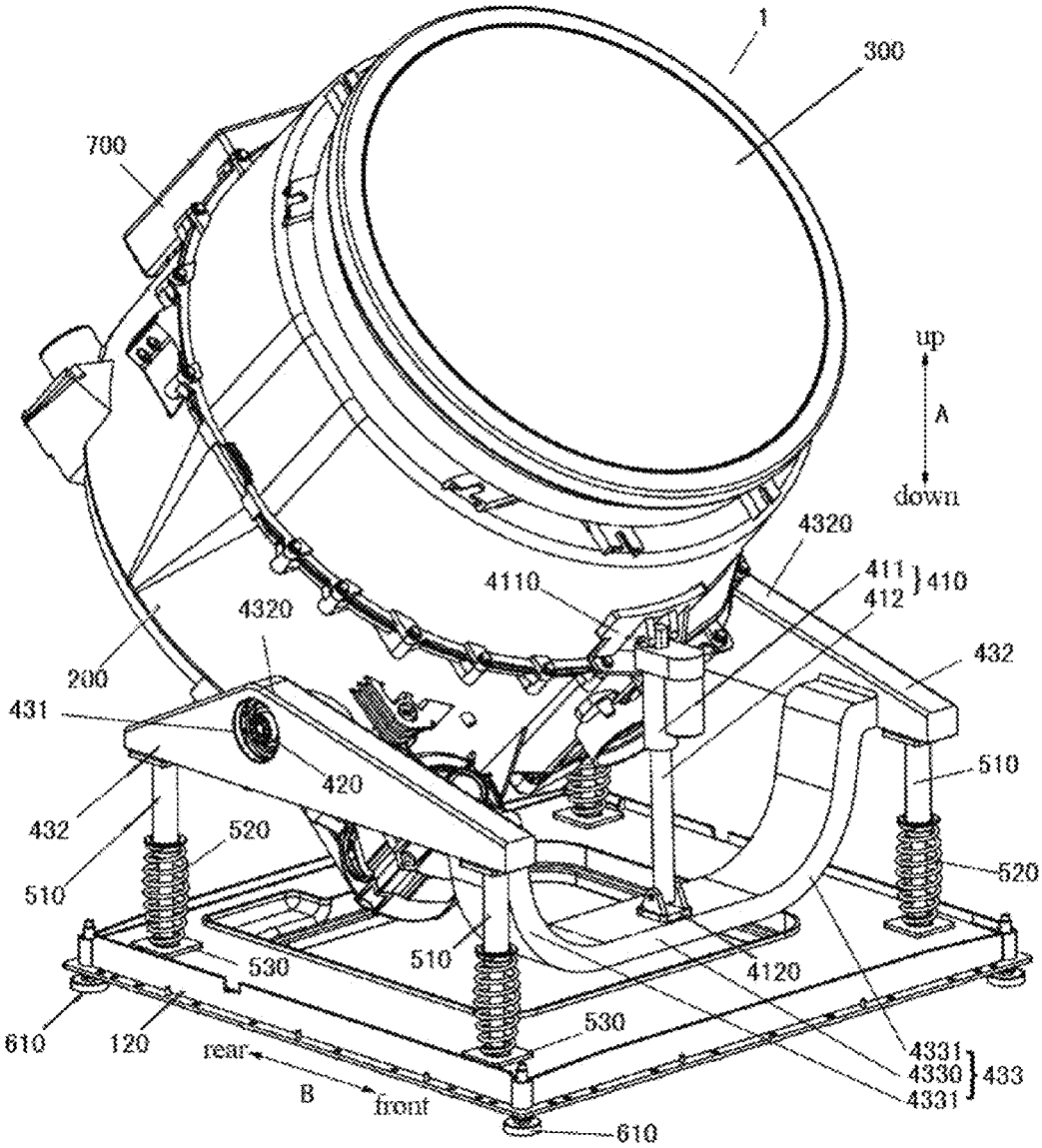
FIG. 3 is a partially schematic view of a front-loading washing machine according to embodiments of the present disclosure, in which the access port is located at a non-washing position.

The cabinet 100 has a front panel 110 (a front-and-rear direction is indicated by an arrow B shown in FIG. 1 to FIG. 3), and the front panel 110 has an opening 111 formed therein. The tub 200 has an access port, and the tub 200 is disposed in the cabinet 100 and configured to make the access port move up and down (an up-and-down direction is indicated by an arrow A shown in FIG. 1 to FIG. 3) in the opening 111. The drum is disposed in the tub 200. The door unit 300 is mounted to the tub 200 and covers the access port. The driving mechanism 400 is used for driving the tub 200 to move, and the driving mechanism 400 is configured in the cabinet 100 and coupled with the tub 200.

In the front-loading washing machine 1 according to the embodiments of the present disclosure, the tub 200 is configured to make the access port move up and down in the opening 111. Hence, compared with a front-loading washing machine having an access port disposed in a front surface in the related art, the washing machine 1 can make the access port move to a suitable position for a user to load clothes or unload them. For example, the access port may be made to move upwards. The user does not need to stoop or crouch when loading clothes or unloading them. Therefore, not only ordinary users can conveniently add clothes or take clothes out via the access port, but also elderly people and other users who cannot stoop easily can load clothes or unload them successfully, which improves convenience of the washing machine 1.

Furthermore, as the access port may move up and down in the opening 111, the access port can be moved to a position for washing clothes after the clothes are added. For example, the access port can be moved downwards. When the clothes are washed, the drum can roll to drive the clothes to be beaten up and down so as to be washed, which not only reduces abrasion on the clothes, but also no longer needs to fully soak the clothes in water—instead, only needs a small amount of water for washing, thus reducing water consumption and facilitating environment protection.

In addition, the driving mechanism 400 is provided to drive the tub 200. The user can operate the driving mechanism 400 to drive the tub 200 when the user needs to adjust a position of the access port. The user can adjust a position of the tub 200 more effortlessly, to facilitate adjusting the position of the tub 200, so as to further improve convenience of the washing machine 1 when the elderly people and similar users use the washing machine 1.

That is, in the washing machine 1, the tub 200 is configured to make the access port move up and down in the opening 111, and the driving mechanism 400 is provided to drive the tub 200 to move. In such a way, the washing machine 1 can not only achieve a washing effect as a common front-loading washing machine when washing clothes, but also adjust the access port to a suitable position for loading clothes or unloading them, which overcomes the problem that clothes cannot be conveniently loaded or unloaded from a front-loading washing machine in the related art, and hence makes it convenient for the user to use.

Accordingly, the front-loading washing machine 1 according to the embodiments of the present disclosure has the advantages of user-friendliness, little clothes abrasion, water saving and the like.

In the following, the front-loading washing machine 1 according to special embodiments of the present disclosure will be described with reference to the drawings.

In some specific embodiments of the present disclosure, as shown in FIG. 1 to FIG. 5, the front-loading washing machine 1 according to the embodiments of the present disclosure includes the cabinet 100, the tub 200, the rotatable drum, the door unit 300 and the driving mechanism 400.

The driving mechanism 400 drives the access port to move up and down between a non-washing position and a washing position in the opening 111. Thus, the driving mechanism 400 can be used for driving the tub 200 to make the access port move to the washing position so as to wash clothes, when the clothes needs washing; and the driving mechanism 400 can be used for driving the tub 200 to make the access port move to the non-washing position convenient for the user to add clothes or take clothes out, when the clothes does not need washing.

Specifically, as shown in FIG. 1 to FIG. 3, when the access port is located at the non-washing position (as shown in FIG. 3), the access port moves close to an upper edge of the front panel 110; when the access port is located at the washing position (as shown in FIG. 1 and FIG. 2), the access port moves close to a lower edge of the front panel 110. Hence, when the user needs to load the clothes or unload them, the access port can be moved close to the upper edge of the front panel 110 to make it convenient for the user to load the clothes or unload them from above; and when the user needs to wash the clothes, the access port can be moved close to the lower edge of the front panel 110 to wash the clothes through rolling of the drum.

Specifically, as shown in FIG. 1, the front panel 110 can incline backwards from the bottom up, so as to further make it convenient for the user to load the clothes or unload them when the access port moves to the non-washing position.

Advantageously, as shown in FIG. 2 and FIG. 3, the driving mechanism 400 is configured to drive the access port to move upwards to approach the upper edge of the front panel 110 and move downwards to approach the lower edge of the front panel 110. When the user needs to load the clothes or unload them, the user can operate the driving mechanism 400 to make the access port move upwards to approach the upper edge of the front panel 110, so as to adjust the position of the access port conveniently; and when the user needs to wash the clothes, the user can operate the driving mechanism 400 to make the access port move downwards to approach the lower edge of the front panel 110, so as to wash the clothes through rolling of the drum.

Optionally, the access port has a motion scope in the opening 111 configured in such a way that an included angle between a central axis of the access port and a horizontal plane is 0 degree to 90 degrees. In other words, the access port can move between a first position where the central axis thereof lies horizontally and a second position where the central axis thereof stands vertically. Specifically, when the access port is located at the non-washing position suitable for loading the clothes or unloading them, the central axis of the access port can be oriented along a vertical direction; and when the access port is located at the washing position suitable for washing the clothes, the central axis of the access port can be oriented along a horizontal direction. Thus, it is convenient for the user to put in or take out the clothes from above and to wash the clothes through rolling of the drum.

Those skilled in the related art should understand that a motion standard of the access port can be adjusted according to actual needs. For example, when the access port is located at the non-washing position (as shown in FIG. 3), the central axis of the access port can incline forwards from the bottom up, which can also make it convenient for the user to load the clothes or unload them. When the access port is located at the washing position (as shown in FIG. 1 and FIG. 2), the central axis of the access port can also have a predetermined included angle relative to the horizontal direction on the premise that the clothes in the drum can be washed in a rolling way.

Preferably, the motion scope of the access port is configured in such a way that the included angle between the central axis of the access port and the horizontal plane is 13 degrees to 45 degrees herein. Therefore, the user can conveniently load clothes or unload them from the upper front, and the washing effect of the clothes can be guaranteed. In addition, the driving mechanism 400 can drive the tub 200 conveniently, and time for moving between two positions of the tub 200 can be reduced to improve the washing efficiency.

FIGS. 2-5 show the front-loading washing machine 1 according to a specific embodiment of the present disclosure. As shown in FIG. 2 to FIG. 5, the driving mechanism 400 includes a longitudinal pushrod 410 disposed at a front side of the tub 200, a transverse shaft 420 disposed at a rear side of the tub 200 and coupled with the tub 200, and a support frame 430 disposed to the cabinet 100 and having a hole 431, in which the transverse shaft 420 rotates in the hole 431 of the support frame 430. The tub 200 can be rotatably disposed to the support frame 430 by the transverse shaft 420, to make the access port move up and down in the opening 111, and the tub 200 can be driven to move by the longitudinal pushrod 410, to adjust the position of the access port. In addition, by disposing the transverse shaft 420 at the rear side of the tub 200 and disposing the longitudinal pushrod 410 at the front side of the tub 200, it is convenient to push the front side of the tub 200 to move in an up-and-down direction by the longitudinal pushrod 410, so as to facilitate adjusting the position of the access port.

Figure 4:
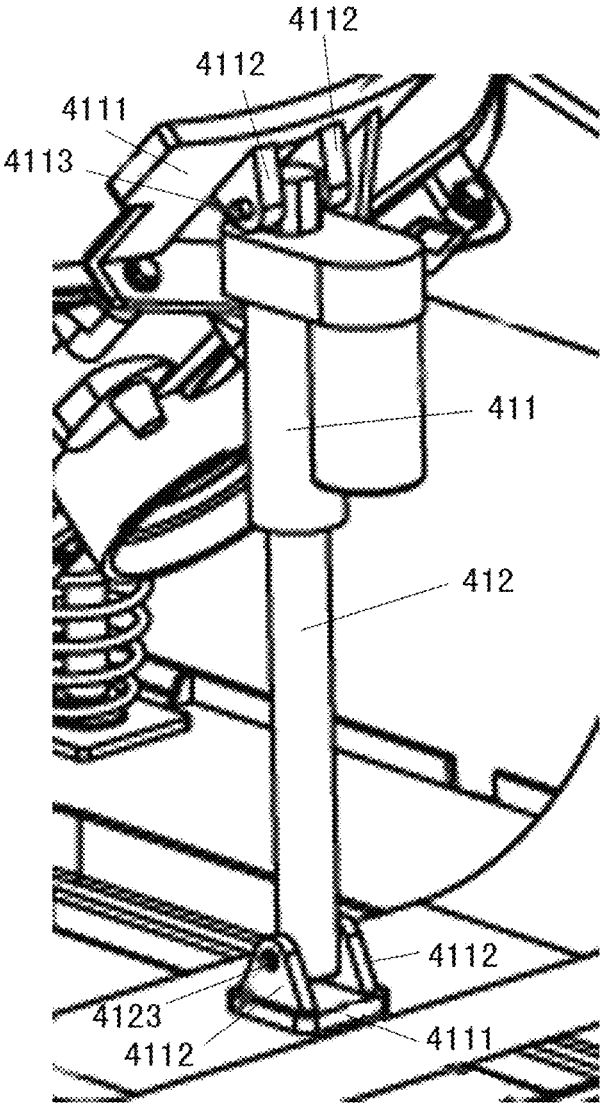
FIG. 4 is a partially schematic view of a front-loading washing machine according to embodiments of the present disclosure.

Specifically, as shown in FIG. 2 to FIG. 4, the longitudinal pushrod 410 includes a drive portion 411 and a telescopic portion 412. The telescopic portion 412 is mounted to the drive portion 411 and driven to telescope by the drive portion 411. One of the drive portion 411 and the telescopic portion 412 is mounted in the cabinet 100, and the other thereof is coupled with the tub 200. Therefore, the drive portion 411 can be used for driving the telescopic portion 412 to telescope to make the longitudinal pushrod 410 telescope, such that the longitudinal pushrod 410 drives the front side of the tub 200 to move in the up-and-down direction, so as to adjust the position of the access port.

Those skilled in the related art should understand that the tub 200 also can be driven by the longitudinal pushrod 410 alone. For example, the tub 200 can be moved in the up-and-down direction by disposing the longitudinal pushrod 410, and the position of the access port can be adjusted, too.

Advantageously, as shown in FIG. 2 to FIG. 4, the drive portion 411 is coupled with the tub 200 through a drive portion mounting frame 4110, and the telescopic portion 412 is mounted in the cabinet 100 through a telescopic portion mounting frame 4120. Specifically, the telescopic portion 412 can be mounted to the support frame 430 through the telescopic portion mounting frame 4120. Thus, it is convenient to mount the drive portion 411 to the tub 200, and mount the telescopic portion 412 in the cabinet 100.

Specifically, the drive portion 411 can drive the telescopic portion 412 through hydraulic pressure.

Optionally, as shown in FIG. 2 to FIG. 4, at least one of connections between the drive portion 411 and the drive portion mounting frame 4110 and between the telescopic portion 412 and the telescopic portion mounting frame 4120 is pivotable. Therefore, not only the tub 200 can move smoothly to facilitate adjusting the position of the access port, but also a motion scope of the tub 200 can be enlarged to guarantee the motion scope of the access port.

Specifically, the drive portion 411 is pivotably mounted to the drive portion mounting frame 4110, and the telescopic portion 412 is pivotably mounted to the telescopic portion mounting frame 4120.

As shown in FIG. 2 to FIG. 4, the drive portion 411 is connected with the drive portion mounting frame 4110 through a drive portion positioning pin 4113, and the telescopic portion 412 is connected with the telescopic portion mounting frame 4120 through a telescopic portion positioning pin 4123. Therefore, the drive portion 411 can be pivotably connected with the drive portion mounting frame 4110, and the telescopic portion 412 is pivotably connected with the telescopic portion mounting frame 4120.

More specifically, shown in FIG. 2 to FIG. 4, each of the drive portion mounting frame 4110 and the telescopic portion mounting frame 4120 includes a mounting plate 4111 and two mounting lugs 4112. The two mounting lugs 4112 are used for assembling the drive portion positioning pin 4113 or the telescopic portion positioning pin 4123, and the two mounting lugs 4112 are disposed on the mounting plate 4111 and spaced apart from each other. Specifically, the mounting lugs 4112 may be provided with a pin hole, the drive portion positioning pin 4113 or the telescopic portion positioning pin 4123 may be fitted in the corresponding pin hole, and the mounting plate 4111 may be mounted on the cabinet 100 or the tub 200 through a threaded fastener (a screw or a bolt), or the mounting plate 4111 and the tub 200 may be formed integrally through injection molding. Therefore, contact areas between the drive member mounting frame 4110 and the tub 200 and between the telescopic portion mounting frame 4120 and the cabinet 100 can be increased, thus facilitating the mounting of the drive portion mounting frame 4110 and the telescopic portion mounting frame 4120, and guaranteeing connection strength and stability of the drive portion mounting frame 4110 and the telescopic portion mounting frame 4120 after the mounting; moreover, the drive portion 411 can be pivotably connected with the drive portion mounting frame 4110 conveniently, and the telescopic portion 412 can be pivotably connected with the telescopic portion mounting frame 4120 conveniently, thus guaranteeing strength and stability of the connection between the drive portion 411 and the drive portion mounting frame 4110, and guaranteeing strength and stability of the connection between the telescopic portion 412 and the telescopic portion mounting frame 4120.

Specifically, the drive portion positioning pin 4113 has two ends provided with anti-falling-out structures for preventing the drive portion position pin 4113 from falling out of the pin hole where the drive portion position pin 4113 is, and the telescopic portion positioning pin 4123 has two ends provided with anti-falling-out structures for preventing the telescopic portion position pin 4123 from falling out of the pin hole where the telescopic portion position pin 4113 is.

FIG. 2 and FIG. 3 show the front-loading washing machine 1 according to a specific embodiment of the present disclosure. As shown in FIG. 2 and FIG. 3, the driving mechanism 400 includes the longitudinal pushrod 410, the transverse shaft 420 and the support frame 430.

Advantageously, the transverse shaft 420 is integrally formed on the tub 200. Thus, it is possible to guarantee the connection strength between the transverse shaft 420 and the tub 200, simplify an assembling process of the transverse shaft 420, and raise the production efficiency of the washing machine 1.

Specifically, the transverse shaft 420 and the tub 200 can be formed integrally through injection molding.

Specifically, as shown in FIG. 2 and FIG. 3, the support frame 430 includes two longitudinal brackets 432 and a transverse bracket 433. The two longitudinal brackets 432 are spaced apart from each other on the cabinet 100, and provided with holes 431. The transverse bracket 433 has two ends connected with the two longitudinal brackets 432 respectively, and the longitudinal pushrod 410 is mounted on the transverse bracket 433. Therefore, the support frame 430 can be conveniently used to support the tub 200, and stability of the tub 200 can be raised.

More specifically, as shown in FIG. 2 and FIG. 3, the transverse bracket 433 includes a main body portion 4330 lower than the two longitudinal brackets 432, and two arc portions 4331 which are located at two ends of the main body portion 4330 respectively and connected with the two longitudinal brackets 432 respectively; and the longitudinal pushrod 410 is mounted to the main body portion 4330. In other words, the transverse bracket 433 may be U-shaped. When the washing machine 1 starts washing, the rotation of the drum makes the tub 200 vibrate and displace, and vibration and displacement of the tub 200 will be transmitted to the transverse bracket 433 through the two longitudinal brackets 432. By disposing the transverse bracket 433 that includes the main body portion 4330 and the two arc portions 4331, it is possible to reduce influence on the transverse bracket 433 caused by the vibration, and buffer the vibration and displacement of the longitudinal brackets 432 by the transverse bracket 433, thus reducing the vibration amplitude of the washing machine 1, and reducing noise of the washing machine 1 during work.

More advantageously, as shown in FIG. 2 and FIG. 3, each of the longitudinal brackets 432 has a protrusion 4320 protruding upwards at its upper surface, and the hole 431 is provided in the protrusion 4320 of each longitudinal bracket 432, which cannot only facilitate forming the hole 431, but also guarantee structural strength of each longitudinal bracket 432 at the hole 431, so as to guarantee the overall structural strength of each longitudinal bracket 432 and further improve the stability of the tub 200.

Specifically, the hole 431 may pass through each longitudinal bracket 432 along a thickness direction of each longitudinal bracket 432.

FIG. 2 and FIG. 3 show the front-loading washing machine 1 according to a specific embodiment of the present disclosure. As shown in FIG. 2 and FIG. 3, the transverse shaft 420 is rotatably fitted in the hole 431 through a bearing. In such a way, it is possible to reduce a force of fraction on the transverse shaft 420 during its rotation, thereby making the tub 200 rotate more smoothly and reducing a force required by the longitudinal pushrod 410 to drive the tub 200, and to slow down an abrasion speed between the transverse shaft 420 and the hole 431, thus prolonging a service life of the front-loading washing machine 1 with the access port.

Specifically, the hole 431 is provided with, at its internal circumferential wall, a limiting protrusion and an assembling groove spaced apart from each other in an axial direction of the hole 431; the assembling groove is provided with a split washer therein; and the bearing is stopped between the limiting protrusion and the split washer. Therefore the limiting protrusion and the split washer can be used to limit the bearing, so as to prevent the bearing from falling out from the hole 431, and raise the reliability of the washing machine 1.

More specifically, the split washer includes an open loop portion and two stop portions, the open loop portion is disposed in the corresponding assembling groove, and the two stop portions are disposed at two ends of the open loop respectively and extend out from the assembling groove where the open loop portion is. Therefore, the two stop portions can be used to stop the bearing, to position the bearing and prevent the bearing from falling out from the hole 431.

Figure 5:
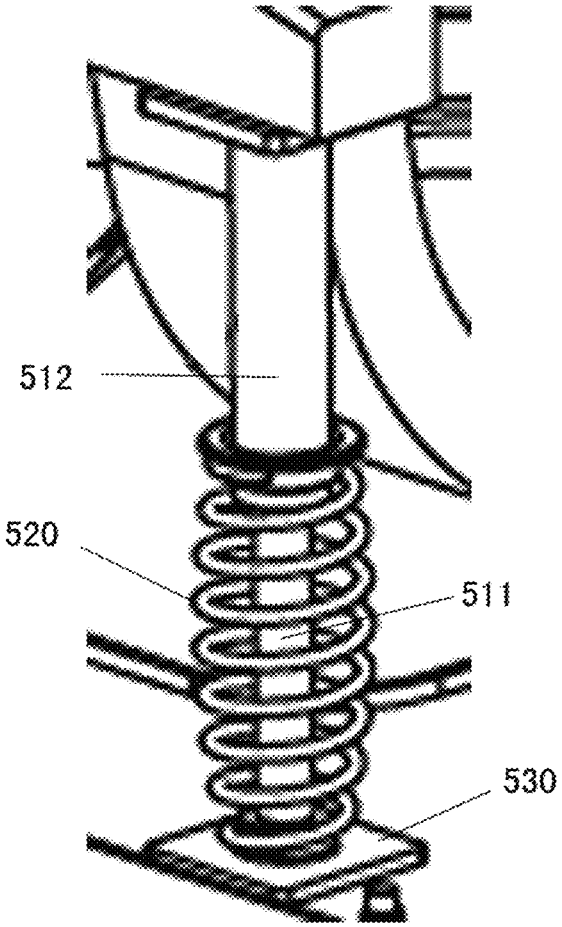
FIG. 5 is a partially schematic view of a front-loading washing machine according to embodiments of the present disclosure.

FIG. 2, FIG. 3 and FIG. 5 show the front-loading washing machine 1 according to a specific embodiment of the present disclosure. As shown in FIG. 2, FIG. 3 and FIG. 5, the driving mechanism 400 includes the longitudinal pushrod 410, the transverse shaft 420 and the support frame 430.

Advantageously, as shown in FIG. 2, FIG. 3 and FIG. 5, the front-loading washing machine 1 further includes a damping vibration absorption mount 500 supported between the cabinet 100 and the support frame 430. Therefore, the damping vibration absorption mount 500 can be used to support the support frame 430 and buffer vibration of the support frame 430, to damp a displacement of the support frame 430, so as to make the washing machine 1 more stable in the washing process.

Specifically, as shown in FIG. 2, FIG. 3 and FIG. 5, the damping vibration absorption mount 500 includes at least one set of damper 510 and vibration absorption elastic member 520. The damper 510 is supported between the cabinet 100 and the support frame 430. The vibration absorption elastic member 520 is connected with the damper 510 and one of the cabinet 100 and the support frame 430. Therefore, the vibration absorption elastic member 520 can be used to buffer the vibration of the support frame 430, and the damper 510 can be used to damp the displacement of the support frame 430. If an elastic member is used alone to absorb vibration, rigidity of the elastic member needs reducing to guarantee a vibration absorption effect, which shortens the service life of the elastic member and causes premature failure. If a damper is used independently to absorb vibration, only a sufficiently great damping force can absorb the vibration, which makes it difficult for the washing machine to raise speed, causes large vibration and noise, degrades the washing effect and lowers the washing efficiency. That is, the damping vibration absorption mount 500 can buffer the vibration and displacement of the support frame 430 by adopting the damper 510 and the vibration absorption elastic member 520 simultaneously. Therefore, it is possible to offset or reduce hard impacts caused by unbalance loads, thereby improving the damping effect of the support frame 430 and reducing the vibration and noise of the washing machine 1 during work, and meanwhile guarantee transverse and longitudinal stabilities of the washing machine to maintain a dynamic controllable posture of the washing machine 1 in a predetermined scope, so as to raise the controllability of the washing machine and guarantee the washing effect of the washing machine 1.

Optionally, the damper 510 is a friction damper, vibration energy can be reduced by fraction of the damper 510, thus facilitating vibration control of the support frame 430. For example, by adjustment, main structural components of the damper 510 in the washing machine 1 can generate slippage and deformation under a predetermined load before yield to provide a damping effect, such that the main structural components can be prevented from yield due to vibration and displacement, and a motion scope of the dynamic controllable posture of the washing machine 1 can be enlarged.

More specifically, as shown in FIG. 5, the friction damper includes a damping internal rod 511 and a damping external cylinder 512. The damping internal rod 511 is connected with one of the support frame 430 and the cabinet 100. The damping external cylinder 512 is movably fitted over the damping internal rod 511 along an axial direction of the damping internal rod 511, and is connected with the other one of the support frame 430 and the cabinet 100. The vibration absorption elastic member 520 is connected with the damping external cylinder 512 and one of the support frame 430 and the cabinet 100. Therefore, friction between the damping internal rod 511 and the damping external cylinder 512 can provide a damping force for the support frame 430, so as to guarantee a vibration absorption effect on the support frame 430.

As shown in FIG. 5, the vibration absorption elastic member 520 is configured as a spring and fitted over the damping internal rod 511, thus facilitating mounting the vibration absorption elastic member 520, positioning the vibration absorption elastic member 520 by the damping internal rod 511, and preventing the vibration absorption elastic member 520 from shifting.

FIG. 2, FIG. 3 and FIG. 5 show the front-loading washing machine 1 according to a specific embodiment of the present disclosure. As shown in FIG. 2, FIG. 3 and FIG. 5, the damping internal rod 511 is mounted on the cabinet 100, the damping external cylinder 512 is mounted on the support frame 430, and the vibration absorption elastic member 520 is connected with the damping external cylinder 512 and the cabinet 100, so as to mount the damping vibration absorption frame mount 500 and guarantee the vibration absorption effect of the damping vibration absorption frame mount 500.

Advantageously, as shown in FIG. 5, the cabinet 100 is provided with a support leg 530 having an inserting hole, and the damping internal rod 511 is inserted in the inserting hole. Therefore, the damping vibration absorption frame mount 500 can be mounted conveniently, and the inserting hole can be used to position the damping vibration absorption frame mount 500 to prevent the damping vibration absorption frame mount 500 from shifting.

Optionally, as shown in FIG. 5, four sets of dampers 510 and vibration absorption elastic members 520 are distributed at four corners of one rectangular. Therefore, the four sets of dampers 510 and vibration absorption elastic members 520 can be used to absorb vibration of the support frame 430, thus improving the vibration absorption effect on the support frame 430, and making forces on the support frame 430 more balanced to further improve the vibration absorption effect on the support frame 430.

Specifically, as shown in FIG. 2 and FIG. 3, the cabinet 100 has a bottom panel 120 located at a bottom thereof, and the damping vibration absorption frame mount 500 is mounted on the bottom panel 120, thus facilitating mounting the damping vibration absorption frame mount 500 and other components.

More advantageously, the bottom panel 120 is configured as a plastic member, so the bottom panel 120 can absorb noise in the cabinet 100, so as to further reduce the noise of the washing machine 1 during work.

More specifically, as shown in FIG. 2 and FIG. 3, the front-loading washing machine 1 further includes an adjustable bottom foot 600 used for supporting the cabinet 100 and adjusting a height of the cabinet 100; and the adjustable bottom foot 600 is screw-thread fitted with the bottom panel 120 and provided with a vibration absorption pad 610. Therefore, the height of the bottom panel 120 can be adjusted by adjusting the adjustable bottom foot 600, and the vibration absorption pad 610 can be used to further buffer vibration of the bottom panel 120, so as to reduce the vibration and noise of the washing machine 1.

Furthermore, the tub 200 may be provided with a balance block 700, so the balance block 700 can be used to balance a central position of the tub 200, raise inertia of the tub 200 and reduce the vibration amplitude during high-speed spinning.

Specifically, the tub 200 may include a front drum and a rear drum which are connected by a flange. A plurality of balance blocks 700 can be provided and distributed on the front drum and the rear drum according to actual needs.

Other configurations and operation of the front-loading washing machine according to embodiments of the present disclosure are known for those skilled in the art, which will not be described in detail herein.

In the specification, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present disclosure, "a plurality of" means at least two, e.g. two or three and etc., unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications or interaction of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. Furthermore, different embodiments or examples in thus specification can be jointed and combined by those skilled in the art.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A front-loading washing machine, comprising:

a cabinet having a front panel, wherein the front panel is provided with an opening;

a tub having an access port for loading and unloading clothes, wherein the tub is disposed in the cabinet and configured in such a manner that the access port is capable of being moved up and down in the opening;

a rotatable drum disposed in the tub;

a door unit mounted to the tub and configured to cover the access port;

a driving mechanism configured to drive the tub to rotate, wherein the driving mechanism is provided in the cabinet and coupled with the tub, the driving mechanism comprises a longitudinal pushrod disposed at a front side of the tub, and the longitudinal pushrod comprises a drive portion and a telescopic portion; and a support frame comprising two longitudinal brackets and a transverse bracket, wherein the two longitudinal brackets are spaced apart from each other, the transverse bracket has two ends connected with the two longitudinal brackets respectively, the tub being pivotable about a pivot point in each of the two longitudinal brackets, and the longitudinal pushrod being mounted on the transverse bracket;

wherein the support frame, the tub, and the driving mechanism are dampened relative to the cabinet by a damping vibration absorption mount comprised of a plurality of dampers that connect the two longitudinal brackets to the cabinet.

2. The front-loading washing machine according to claim 1, wherein the driving mechanism is configured to drive the access port to move up and down between a washing position and a non-washing position in the opening.

3. The front-loading washing machine according to claim 2, wherein when the access port is located at the non-washing position, the access port is driven to move close to an upper edge of the front panel, and when the access port is located at the washing position, the access port is driven to move close to a lower edge of the front panel.

4. The front-loading washing machine according to claim 1, wherein the driving mechanism is configured to drive the access port to move upwards to close to an upper edge of the front panel and move downwards to close to a lower edge of the front panel.

5. The front-loading washing machine according to claim 1, wherein the telescopic portion is mounted to the drive portion and driven to telescope by the drive portion, one of the drive portion and the telescopic portion being mounted in the cabinet, and the other thereof being coupled with the tub.

6. The front-loading washing machine according to claim 5, wherein the drive portion is coupled with the tub through a drive portion mounting frame, and the telescopic portion is mounted in the cabinet through a telescopic portion mounting frame.

7. The front-loading washing machine according to claim 6, wherein at least one of the connections between the drive portion and the drive portion mounting frame and between the telescopic portion and the telescopic portion mounting frame is pivotable.

8. The front-loading washing machine according to claim 7, wherein the drive portion is connected with the drive portion mounting frame through a drive portion positioning pin, and the telescopic portion is connected with the telescopic portion mounting frame through a telescopic portion positioning pin.

9. The front-loading washing machine according to claim 8, wherein each of the drive portion mounting frame and the telescopic portion mounting frame comprises:

a mounting plate; and two mounting lugs, used for assembling the drive portion positioning pin or the telescopic portion positioning pin, disposed on the mounting plate and spaced apart from each other.

10. The front-loading washing machine according to claim 1, further comprising a transverse shaft disposed proximate to a rear edge and lower side of the tub and coupled to the tub, wherein the rear edge is opposite the access port and the lower side faces a base of the cabinet.

11. The front-loading washing machine according to claim 10, wherein the transverse shaft is configured to rotate about the pivot point in each of the two longitudinal brackets.

12. The front-loading washing machine according to claim 1, wherein the transverse bracket is U-shaped.

13. The front-loading washing machine according to claim 1, wherein ends of the transverse bracket are above the main body portion of the transverse bracket.

* * * * *